US005746118A

United States Patent [19]

Brunner et al.

[11] Patent Number: 5,746,118

[45] Date of Patent: May 5, 1998

[54] HOLDING DEVICE FOR A COOKING PRODUCT CARRIER

[75] Inventors: Dieter Brunner; Joachim Damrath, both of Gaggenau; Martin Kornberger, Baden-Baden, all of Germany

[73] Assignee: Gaggenau Hausgerate GmbH, Gaggenau, Germany

[21] Appl. No.: 863,758

[22] Filed: May 27, 1997

[30] Foreign Application Priority Data

Jun. 5, 1996 [DE] Germany ..... 196 22 608.2

[51] Int. Cl.[6] ..... A47J 37/00; A47J 37/06; F24C 15/16

[52] U.S. Cl. ..... 99/427; 99/449; 99/450; 99/476; 126/9 R; 126/41 R

[58] Field of Search ..... 99/339, 340, 349–351, 99/374–379, 385–391, 426, 448–450, 476–479, 427; 126/25 R, 25 A, 9 R, 41 R, 41 B, 21 A; 219/388, 400; 426/523

[56] References Cited

U.S. PATENT DOCUMENTS

| | | | |
|---|---|---|---|
| 4,317,441 | 3/1982 | Berg | 126/41 R |
| 4,583,452 | 4/1986 | Grosse | 99/427 |
| 5,113,699 | 5/1992 | Soriano | 99/449 X |
| 5,158,010 | 10/1992 | Rosenberger | 99/477 X |
| 5,163,359 | 11/1992 | McLane, Sr. | 126/41 R |
| 5,213,027 | 5/1993 | Tsotsos et al. | 126/9 R |
| 5,261,388 | 11/1993 | Wright et al. | 126/41 R |
| 5,331,942 | 7/1994 | McDonald et al. | 126/25 R |
| 5,341,727 | 8/1994 | Dickson | 99/349 X |
| 5,445,063 | 8/1995 | Sherman | 99/427 X |
| 5,447,096 | 9/1995 | Burge et al. | 99/450 X |
| 5,598,769 | 2/1997 | Luebke et al. | 99/476 X |
| 5,640,895 | 6/1997 | Anetsberger | 99/349 |

FOREIGN PATENT DOCUMENTS

| | | |
|---|---|---|
| 0147815 | 12/1984 | European Pat. Off. . |
| 02611461 | 9/1977 | Germany . |
| 8701330 | 11/1987 | Germany . |
| 9211953 | 12/1992 | Germany . |
| 4236740 | 5/1994 | Germany . |

*Primary Examiner*—Timothy F. Simone

*Attorney, Agent, or Firm*—Sprung Kramer Schaefer & Briscoe

[57] ABSTRACT

A holding device for at least one cooking product carrier in a baking oven by means of which the cooking product carrier can be drawn out of the baking oven muffle and slid back into it, is to be improved with regard to its operating characteristics. For this purpose, holding device (8) has at least one parallelogram linkage (10, 11, 16, 17) with a base arm (11) which is in a fixed-position in relation to the baking oven muffle (1), pivot arms (16, 17) articulated at articulation points (12, 13, 14, 15) and a movable mounting arm (10) of a holding element (9) of the cooking product carrier (24) which can be moved with it. The articulation point (14) of the rear pivot arm (16) is arranged approximately in the middle one-third of the longitudinal dimension of the fixed-position base arm (11) such that the holding device (8) assumes a defined end position both in its withdrawn position and in its inserted position and such that the cooking product carrier in its withdrawn position will protrude from the baking oven muffle. Furthermore, the fixed-position base arm (11) has a rearward mounting end (30), by means of which the holding device (8) is removably mounted at a rearward baking oven wall (3).

12 Claims, 3 Drawing Sheets

Figure 1:
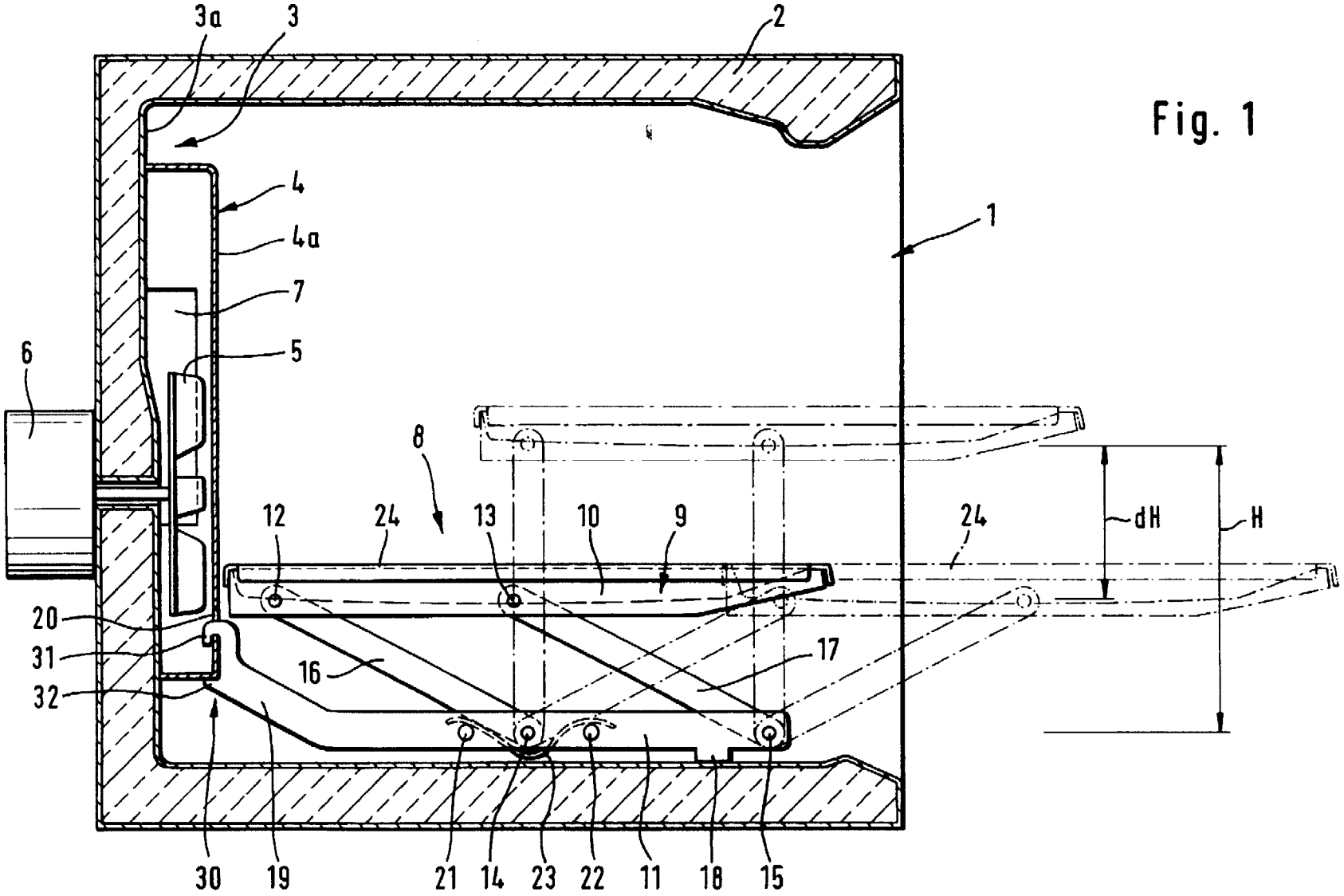

H
dH
1
2
3
3a
4
4a
5
6
7
8
9
10
11
12
13
14
15
16
17
18
19
20
21
22
23
24
24
30
31
32

HOLDING DEVICE FOR A COOKING PRODUCT CARRIER

The invention relates to a movable holding device for at least one cooking product carrier in a baking oven, by means of which the cooking product carrier can be drawn out of the baking oven muffle and slid back into it.

A cooking product carrier is, for example, a baking tray, a supporting gridiron or other carrier which is suitable for accommodation of a product for cooking or baking. This document hereafter refers predominantly, but without restriction of general applicability, to a baking tray as an example of a cooking product carrier.

Guides which are arranged in the baking oven muffle, for baking trays located one above the other, are known in a wide range of embodiments. In this context, both parallel rail guides with guide rails arranged on both sides on the vertical inner wall surfaces of the baking oven muffle - and baking tray mountings on the front wall which can be manoeuvred using a carriage-type holding means - are known. Furthermore, telescopically extending rails with rollers are known.

Support in grooves pressed into the vertical side walls of the baking oven muffle, between which the baking tray directly slides, provides a particularly simple means of guidance. However, such support generally produces rough, stiff guidance in movement and thus fails to fulfil the requirements for convenient handling.

In the case of baking ovens whose operating temperatures are not too high (without pyrolytic selfcleaning), also chromium rails are used, which improve the sliding of baking trays. However, this method, too, fails to achieve the desired smooth sliding action.

Previously known embodiments comprising support for baking trays on horizontal guide rails on the inner wall surfaces of baking tray muffles furthermore are disadvantageous inasmuch as the baking tray cannot be drawn far enough out without incurring the risk of tipping. For example, during the inspection of the degree of browning of small bakery products and when basting larger roast items, this imposes considerable disadvantages.

It is therefore an object of the invention to provide a device for holding a cooking product carrier which can be inserted into the baking oven muffle when needed, which combines a smooth sliding action with the capacity to allow withdrawal from the baking oven muffle almost to the complete length of the cooking product carrier. This objective is fulfilled by means of a holding device, which possesses at least one parallelogram linkage with a base arm which is fixed in position in relation to the baking oven muffle. By means of pivot arms of identical length, hinge-mounted at articulation points, the fixed-position arm is connected to a mounting arm fixed to (preferably unitary with) a holding element of the movable cooking product carrier which can move in parallel to the fixed-position arm. The spacing of the articulation points on the fixed-position arm and the spacing of the articulation points on the movable mounting arm are identical. The articulation point of the rear pivot arm (i.e. the arm closer to the rear baking oven wall) is arranged approximately in the middle one-third of the longitudinal dimension of the fixed-position base arm such that the holding device assumes a defined end position in both the withdrawn and the inserted position and the cooking product carrier protrudes from the baking oven muffle in the withdrawn position. The fixed-position base arm also has a rearward mounting end by means of which the holding device is removably mounted in the oven by a form-locking fixing element, which cooperates with a corresponding fixing means provided at the rear side of the oven.

Parallelogram linkages or guides for baking trays have already been proposed for various purposes and are, for example, known from publications DE-U1-9211953, DE-A-2611461, DE-U1-8701330 and EP-A-0147815. The known devices, however, do not fulfil the requirements of a simple, robust, user-friendly and versatile design, with the result that parallelogram guides of these types are not in practical use.

The holding device according to the invention can, thanks to its form-locking and removable mounting, be fitted easily in the baking oven muffle as an accessory or retrofit component for particular applications as desired. The ease of removability of the device thus not only facilitates cleaning of the baking oven muffle, but is also a prerequisite for the possibility of using the baking oven for a wide range of applications necessitating subsequent, temporary installation of accessories into the muffle, for example baking with a plurality of trays in air-circulation mode, grilling with a rotating spit or baking on a pizza block.

Preferably, the mounting end of the fixed-position arm is removably mounted not directly on the back wall of the baking oven muffle, which forms the thermal limit, but on a component mounted in front of the back wall particularly on an intermediate wall. This has the advantage that no cooking vapours can escape from the baking oven muffle and thermal losses are kept low, because the thermally limiting boundary of the baking oven muffle is not penetrated.

As a consequence of the arrangement of the articulation points of the pivot arms on the fixed-position base arm according to the invention, a geometry of the parallelogram linkage results by which the holding device assumes a defined, fixed position at both end positions, only due to its own weight and without additional holding components.

For e.g. purposes of inspection of the degree of browning or for basting a roast the holding element and the baking tray which moves with it can be drawn out in a continuously horizontal orientation from the baking oven muffle, without risk of tipping. The outward pivoting movement takes place independently of the operation of the baking oven door. In the extended end position, the baking tray protrudes from the baking oven muffle and is thus readily accessible.

The movement process and the length of extension can be adapted to the relevant conditions by the geometry of the parallelogram linkage, for example by varying the dimensions of the pivot arms, varying the positioning of the articulation points on the fixed-position arm and varying the spacings of the articulation points on the fixed-position arms and on the movable mounting arm in relation to each other. Preferably, the geometry is selected such that at least one half of the baking tray, in relation to its depth, can be drawn out of the baking oven muffle. The parallelogram guide can be designed equilaterally (rhombus) or non-equilaterally. In each case the pivot arms and the horizontal (base and mounting) arms move parallel to each other and have the same spacing of their articulation points in the horizontal plane.

Preferably, in order to limit the extension and insertion movement in the end positions, the holding device is provided with stop elements which limit the movement of the mounting arm and thus of the holding element. They may advantageously be positioned on the fixed-position base arm.

For purposes of damping the stop impact and thus improving ease of handling, it is also advantageous if the limit stops are elastically sprung. For this purpose, at least one metal spring (for example, a leaf spring or wire spring)

can advantageously be provided as a damper. Elastic springing is ideally embodied as a spring support, i.e. the spring excursion is long enough and the spring force is high enough to compensate almost completely the weight of the moving components including the baking tray. A helical spring is particularly suitable for this purpose. The spring support action is advantageously two-sided, i.e. both the insertion and withdrawal movement should be spring-assisted.

For purposes of stabilisation of the parallelogram linkage and thus of the mounting arm which can move in parallel, it may also be useful to configure the pivot arms and the horizontal arms in the area of their articulation points with an enlarged sliding face as a stabilisation surface. The pivot arms may also advantageously be configured as articulated levers, each with an articulation point. Thus the withdrawal length can be extended and/or the height of the construction can be reduced.

Figure 2:
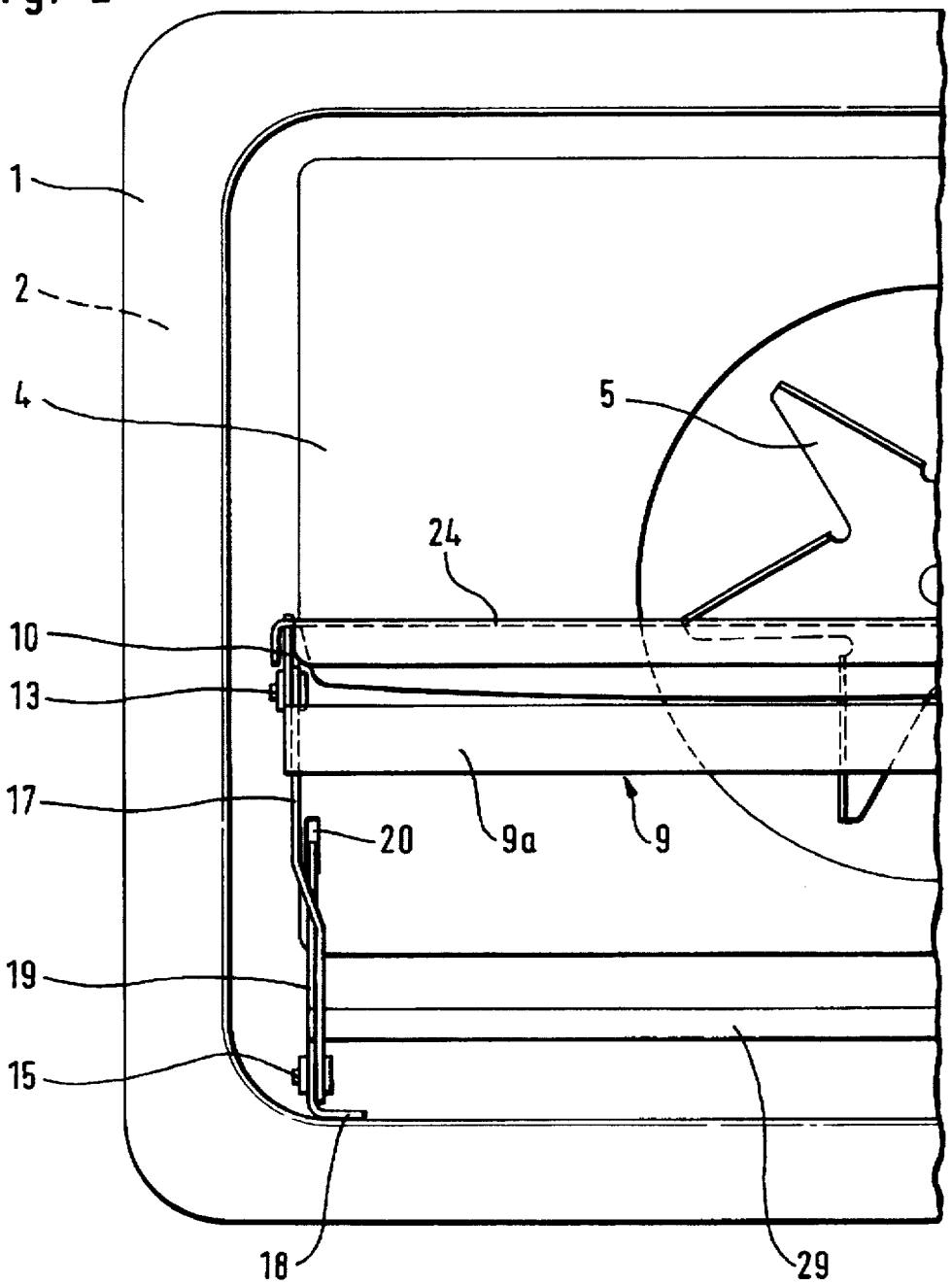
Figure 3:
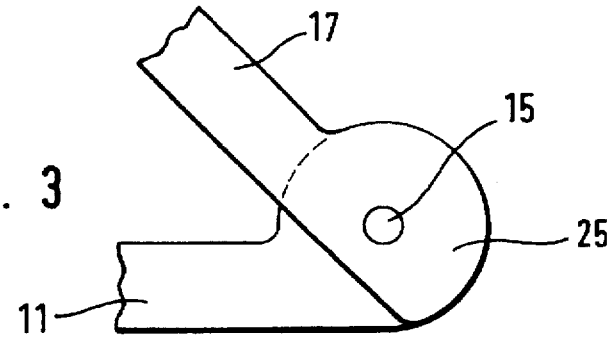
Figure 4:
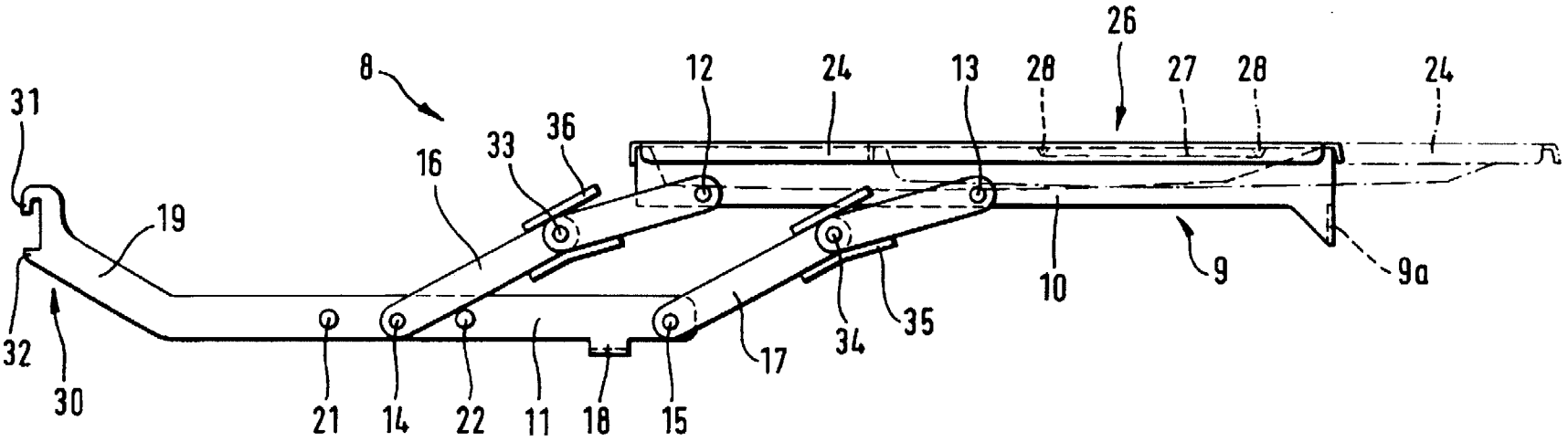

The drawings show embodiments of the invention in schematic representation, wherein:

FIG. 1 shows a longitudinal section through a baking oven muffle with a holding device inserted, FIG. 2 shows a frontal cutaway view of the baking oven muffle with a holding device inserted, FIG. 3 shows a detail view of the articulated guide on a holding device as per FIGS. 1 and 2, FIG. 4 shows a side view of a holding device with an additional longitudinal guide for the baking tray and modified pivot arms.

In FIGS. 1 and 2, there are illustrated a baking oven muffle 1, with thermal insulation 2, typically consisting of mineral wool and enclosing the baking oven muffle. The thermal limit is defined by the wall of baking oven muffle 1. In front of this there is mounted a box-shaped attachment 4 with an intermediate wall 4*a* which runs parallel to the baking oven muffle rear wall 3*a* in the hot zone of the baking oven. The rearward baking oven wall 3 is thus configured partially double-wallled. In the internal compartment between back wall 3*a* of baking oven muffle 1 and box-shaped attachment 4, there is arranged an impeller of a radial fan 5 which is driven by an electric drive motor 6 for purposes of circulation of air in the baking oven muffle 1 in the air circulation baking mode. Corresponding inlet and outlet cutouts 7 are arranged laterally on box-shaped attachment 4.

Holding device 8, carrying preferably a single baking tray, is configured such that it can be mounted in a form-locking and removable mounting suspended on the box-shaped attachment 4 of baking oven muffle 1. The construction of holding device 8 is such that it has a holding element 9 equipped with cross-struts 9*a* running transverse to the direction of withdrawal of holding device 8, whose lateral wall surfaces are configured to form movable mounting arms 10. Mounting arms 10 and fixed-position base arms 11, together with pivot arms 16, 17 in their articulated attachment to points of articulation 12, 13, 14, 15, constitute two parallelogram linkages. These are each adjacent to a vertical lateral wall surface of baking oven muffle 1. The fixed-position base arms 11 are connected by a strut-shaped stabiliser 29 (see FIG. 2) running transverse to the direction of withdrawal. The lateral stability of the parallelogram linkage during the withdrawal and insertion movement is increased by the connection of the movable mounting arms 10 with each other via cross-struts 9*a* and the connection of the fixed arms 11 with each other via stabiliser 29. The spacing of articulation points 12, 13 on mounting arms 10 and of articulation points 14, 15 on fixed-position arms 11 is identical and—in the illustrated case—approximately corresponds to the length of pivot arms 16, 17. The articulation points 14 of rear pivot arms 16 are arranged in the middle one-third of the longitudinal dimension of fixed arms 11.

On the two fixed arms 11, feet 18 are provided which, being configured in the illustrated case as integrally formed angle components, provide support on the inner floor surface of baking oven muffle 1 (see FIG. 2). The advantage of this configuration is that the front ends of the fixed base arms 11 facing the baking oven door each have a defined point of contact on the floor of baking oven muffle 1. This achieves stable positioning of holding device 8 even if the floor is not level.

The fixed base arms 11 each possess an upward angled hook part 19 with a rearward mounting end 30. Hooks 31 are formed on mounting ends 30. These engage in cutouts 20 which, in the shown embodiment are provided on the intermediate wall 4*a* of box-shaped attachment 4 in the form of vertical slot cutouts. Furthermore, the mounting ends 30 each have a projection 32 which interacts with a corresponding counterpart of attachment 4 (in this case its lower limiting wall) to prevent upward movement. By this means, the rear ends of fixed-position arms 11 are fixed in a form-locking arrangement in both vertical planes. Mounting ends 30 thus each constitute a rearward point of contact for the fixed-position arms 11. Rearward fixing in both vertical planes and the essentially point support of the front ends of the fixed arms 11 by the feet 18 on the floor of baking oven muffle 1 thus constitute a 2-point mounting for each of the fixed-position arms 11.

Holding device 8 can readily be inserted, by means of the described design of rearward mounting ends 30, into baking oven muffle 1 and be reliably mounted.

For purposes of providing a stop limit for the pivot motion of support arms 10 and thus for holding element 9, stop pieces 21, 22 are provided in the range of pivot of rear pivot arms 16 on fixed-position arms 11. A hard stop at stop pieces 21, 22 is prevented by a corrugated damper spring 23 which is partially looped around stop pieces 21,22 and articulation point 14.

A baking tray 24 is inserted into holding element 9 and fixed by engagement of its edge.

FIG. 1 illustrates three positions of holding device 8 with baking tray 24 placed on it:

An inner end position (drawn bold),

An intermediate position with the maximum height of the holding device (drawn in broken lines), And the final extended limit position (also drawn in broken lines).

It can be seen that the defined end positions of holding device 8 are symmetrical to the intermediate position. The vertical position of holding element 9 is, in each of the end positions, at least so much lower than in the intermediate position that holding element 9 remains securely in the corresponding end position by its weight alone, without any additional means of securing. In practice, the difference in height dH between the intermediate position and each end position should be at least 20%, and ideally at least 30% of the maximum height H.

The alternative embodiment shown in FIG. 3 has, in the vicinity of an articulation point 15, an enlarged sliding support face 25 of pivot arm 17 with a stabilising effect, wherein the corresponding support area on arm 11 is also adapted and enlarged. A configuration of this type, which can be applied to several (and ideally all) articulation points, will improve the stability of the parallelogram linkage and thus that of the holding device so that, even at a close spacing from the vertical inner wall surfaces of the baking oven oven muffle, it can be pivoted without risk of contact and abrasion.

In the preferred embodiment illustrated in FIG. 4, holding device 8 is in its final extended position. In order to be able to draw baking tray 24 in this position, even further out of the baking oven muffle, holding device 8 has additional design features which enlarge the withdrawal length of baking tray 24. Firstly, holding element 9 has an additional longitudinal guide 26 for baking tray 24. Thus, baking tray 24 can be slid horizontally relative to holding element 9 and thus drawn even further out of the baking oven muffle. In the illustrated case, longitudinal guide 26 has a longitudinal cutout 27 in the mounting arm 10 and a corresponding lug 28 on baking tray 24, thus also achieving a defined limit for the horizontal sliding distance.

Secondly, pivot arms 16, 17 are configured as articulated levers, each with a further articulation point 33, 34. This enables the holding element 9 and thus the baking tray 24, in the final extended position, to protrude even further out of the baking oven muffle. For bilateral limiting of the articulation of pivot arms 16, 17, a front stop 35 and a rear stop 36 should preferably be present on each of the two pivot arms 16, 17. Optionally a notch type lock mechanism (not shown) can be provided for momentary fixation of the link 33, 34 in a desired position.

Preferably, the length of pivot arms 16, 17 is less than 25 cm, and most preferably less than 20 cm. In the case of a holding device 8 with an additional longitudinal guide 26, the length of pivot arms 16, 17 can be reduced. Relatively short pivot arms 16, 17 will increase the stability of holding device 8 during the pivot process. Furthermore, short arms 16, 17 reduce the maximum height of holding device 8 in its intermediate position, such that it can also be used for movement of high cooking products without incurring the risk of contacting the ceiling of baking oven muffle 1.

We claim:

1. Holding device for a cooking product carrier in a baking oven by means of which a cooking product carrier can be drawn out of a baking oven muffle and pushed back into it, comprising a parallelogram linkage with a base arm, which is adapted to be fixed in a fixed position in the baking oven muffle and is connected by a hinged arrangement by means of pivot arms of identical length and articulated at articulation points with a mounting arm of a holding element for the cooking product carrier, the mounting arm being movable in parallel with the fixed-position base arm, wherein the spacing of the articulation points on the fixed-position arm and the spacing of the articulation points on the movable mounting arm are the same, the articulation point of the rear pivot arm is arranged at approximately the middle one-third of the longitudinal dimension of the base arm such that the holding device has a defined end position both in the withdrawn position and in the inserted position, and such that the cooking product carrier in its withdrawn position will protrude from the baking oven muffle and the fixed-position base arm has a rearward mounting end adapted for removably mounting the fixed-position base arm at the rearward baking oven wall by form-locking engagement.

2. Holding device according to claim 1, wherein it has two parallelogram linkages.

3. Holding device according to claim 2, wherein the fixed-position base arms of the two parallelogram linkages are interconnected by means of a stabilising element.

4. Holding device according to claim 1, wherein the fixed-position base arm has on its front end facing the baking oven door a foot which rests on the inner floor surface of the baking oven muffle, such that the foot and the rearward mounting end form defined contact points of the fixed-position arm base in the baking oven muffle.

5. Holding device according to claim 1, wherein the mounting end has a hook-shaped extension for engagement in a cutout provided at the rearward baking oven wall.

6. Holding device according to claim 1, wherein the mounting end has a projection which is configured such that it interacts in a form-locking arrangement with a counterpart provided at the rearward baking oven wall thereby to fix the mounting end in an upward direction.

7. Holding device according to claim 1, wherein it is adapted to be a mounted on a component inside the baking oven muffle which is mounted in front of baking oven muffle rearward wall, which constitutes the thermal limit of the baking oven muffle.

8. Holding device according to claim 1, wherein it has elastically biased stop elements which limit the movement of the mounting arm and thus of the holding element.

9. Holding device according to claim 8, wherein the elastic biasing of the limit stops is configured such that it constitutes spring support for the movement of the mounting arm.

10. Holding device according to claim 1, wherein at least one pivot arm has, in the vicinity of its articulation points an enlarged sliding face acting as a stabilising surface.

11. Holding device according to claim 1, wherein each of the pivot arms is configured with a further articulation point as an articulated lever.

12. Holding device according to claim 1, wherein holding element has an additional longitudinal guide for the cooking product carrier so as to enable horizontal sliding of cooking product carrier in relation to holding element.

* * * * *